US007374441B2

(12) United States Patent
Rubenstein

(10) Patent No.: US 7,374,441 B2
(45) Date of Patent: May 20, 2008

(54) ZERO INSERTION FORCE CONNECTOR ASSEMBLY FOR CIRCUIT BOARDS/CARDS

(75) Inventor: Brandon Rubenstein, Fort Collins, CO (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 11/532,331

(22) Filed: Sep. 15, 2006

(65) Prior Publication Data

US 2008/0070430 A1 Mar. 20, 2008

(51) Int. Cl.
*H01R 13/62* (2006.01)

(52) U.S. Cl. ..... 439/160; 439/153; 439/328; 439/263; 439/264; 439/265

(58) Field of Classification Search ..... 439/160, 439/153, 327, 328, 263–265
See application file for complete search history.

(56) References Cited

U.S. PATENT DOCUMENTS 4,080,027 A * 3/1978 Benasutti ..... 439/260
4,096,547 A * 6/1978 Calabro ..... 361/708
4,159,861 A * 7/1979 Anhalt ..... 439/267
4,648,668 A * 3/1987 Sinisi ..... 439/267
4,743,203 A * 5/1988 Grabbe ..... 439/260
5,533,631 A * 7/1996 Marchetti ..... 211/41.17
5,650,917 A * 7/1997 Hsu ..... 361/759
6,233,158 B1 5/2001 Leman
6,283,778 B1 * 9/2001 Kupnicki et al. ..... 439/260
6,377,445 B1 4/2002 Davis et al.
6,411,517 B1 6/2002 Babin
6,688,902 B1 * 2/2004 Yoon et al. ..... 439/260
6,761,569 B2 7/2004 Nakamura
6,776,632 B2 8/2004 Kikuchi et al.
6,783,926 B2 8/2004 Reece
6,786,409 B2 9/2004 Fujii et al.
6,786,410 B2 9/2004 Kihara
6,840,447 B2 1/2005 Hirata et al.
6,878,000 B2 4/2005 Akasaka et al.
6,883,715 B1 4/2005 Fruhauf et al.
6,884,100 B1 4/2005 Hsiao
6,923,373 B2 8/2005 Kanagawa et al.
6,942,149 B2 9/2005 Fujii et al.

(Continued)

OTHER PUBLICATIONS

Picture of IBM P620 PCI Carrier, admitted prior art no date.

(Continued)

*Primary Examiner*—Renee Luebke
*Assistant Examiner*—Vanessa Girardi

(57) ABSTRACT

An apparatus and method for installing an electrical support structure, such as a printed circuit board or card in a computerized device, are disclosed. In at least some embodiments, the apparatus includes a connector assembly that includes a first structure having a first guiding surface, a second structure having a second guiding surface, a third structure having at least one additional guiding surface that interfaces the other guiding surfaces, and an electrically conductive component supported by at least one of the structures. Movement of the first structure in relation to the second structure in a first direction causes additional movement of the third structure in a second direction due to interaction among the guiding surfaces. Further, at least a portion of the component moves, in response to the additional movement, to or away from a first position at which the component is capable of establishing an electrical connection.

22 Claims, 8 Drawing Sheets

U.S. PATENT DOCUMENTS

| | | | |
|---|---|---|---|
| 6,976,860 | B1 | 12/2005 | Su |
| 7,033,222 | B2 | 4/2006 | Kitamura |
| 7,047,631 | B1 | 5/2006 | Spaulding |

OTHER PUBLICATIONS

Picture of SGI PCI Carrier, admitted prior art no date.
Picture of Sun PCI Carrier, admitted prior art no date.

* cited by examiner

ZERO INSERTION FORCE CONNECTOR ASSEMBLY FOR CIRCUIT BOARDS/CARDS

CROSS-REFERENCE TO RELATED APPLICATIONS

N/A

STATEMENT REGARDING FEDERALLY SPONSORED RESEARCH OR DEVELOPMENT

N/A

FIELD OF THE INVENTION

The present invention relates to computerized devices, and more particularly relates to the assembly of components such as boards and cards within such devices.

BACKGROUND OF THE INVENTION

Computers and other computerized devices often employ boards (e.g., printed circuit boards), cards and other support structures on which are implemented various electrical devices and circuitry such as microprocessors, programmable logic devices (PLDs), and discrete circuit components. Often these support structures are intended to be modular such that the structures can be removed, replaced and/or added in relation to one another and/or other parts of a given computerized device. Typically, support structures of this type include connectors that are capable of being coupled to complementary connectors of other support structures or devices so that electrical connections can be established, and that at the same time facilitate (or at least permit) the repeated coupling and decoupling of the support structures to and from one another. This could also include the case where electrical connection is made by mating a connector on a first or main board to printed contacts on the edge of a second board.

Many conventional boards (or cards) are designed to be coupled to one another in a perpendicular manner. That is, conventional boards are often designed so that, when a first board is coupled to a second board, an edge of the first board is positioned adjacent to a substantially planar surface of the second board and the first board extends substantially normally outward from the substantially planar surface of the second board. Additionally, to establish electrical connections between the boards, the boards typically have or operate in conjunction with complementary connection components that interface one another when the boards are coupled to one another. For example, in some embodiments, connector pins extending normally from the planar surface of the second board can interface complementary electrical sockets associated with the first board.

The assembly of boards in this perpendicular manner is common because it satisfies various design goals, for example, the enhancement of heat dissipation from the boards. Yet the assembly of boards in this manner also leads to complications in terms of the process of assembling the boards. Given the design of typical electrical connection components such as those mentioned above, the assembly of boards in this perpendicular manner naturally calls for movement of the first board in a direction that is normal to the surface of the second board so that pins can proceed into complementary sockets. Yet, movement of a first board in a direction that is normal to the surface of a second board can be unwieldy and impractical in the context of assembling boards on a computerized device. Indeed, if such movement is required in order to assemble boards together, it often becomes necessary that all of the boards be entirely removed from a supportive chassis of the computerized device before the assembly process can take place.

Given these complications, efforts have been made to develop boards and/or connection components that would allow for a first board to be assembled to a second board in a manner that did not involve as much normal motion of the first board relative to the surface of the second board. These efforts have yielded boards and/or connection components in which assembly of the first and second boards is accomplished by first moving the first board in relation to the second board along the surface of the second board (rather than normally toward the surface of the second board), where the first board is sufficiently far apart from the second board such that any connectors such as pins/sockets are not yet in contact with one another, followed by moving the first board slightly in a direction toward the surface of the second board so that contact among the connectors then is established. In such mechanisms, initial movement of the first board along the surface of the second board occurs without being accompanied by interaction of the connectors, so as to avoid possible damage to the connectors that might otherwise occur over time due to friction as the boards are repeatedly assembled and disassembled.

For example, in one such mechanism, the first board is slid inward relative to the second board until the respective connectors on the first and second boards are generally aligned with one another. A hinged connection is then established between the inner corner of the first board and the second board. Subsequently, the first board is rotated toward the surface of the second board until the connectors associated with the two boards are coupled. Further for example, in another such mechanism, the first board is slid inward relative to the second board until the respective connectors are aligned, and then the two boards are compressed together by way of a lever or handle to couple the connectors. In yet another mechanism, a special subchassis is added between the boards to facilitate the desired motion of the first board along the surface of the second board.

Although conventional mechanisms of the above types allow for a first board to be connected to a second board in a manner that does not involve a significant degree of normal movement of the first board relative to the surface of the second board, all of these conventional mechanisms require significant numbers of complicated components to achieve their intended manners of operation. They also often require a multiplicity of different operations by the user to fully mate the two boards. Additionally, in the embodiments where levers/handles are used, the physical feedback provided to a user performing the installation procedure is limited. Further, in the embodiments where the first board is rotated in relation to the second board, the number and positioning of the connectors must be restricted near the hinge since the rotational movement could otherwise place significant frictional stress upon connectors located near the hinge.

For at least these reasons, it would be advantageous if an improved apparatus and method for assembling together support structures such as boards and cards used in computerized devices could be developed. More particularly, it would be advantageous if in at least some embodiments the improved apparatus and method in at least some embodiments allowed for the assembly of such support structures in a manner that involved only limited amounts of normal movement of one structure relative to a surface of another structure. Additionally, it would be advantageous if in at least some embodiments the improved apparatus and method involved less complicated components than those employed in the above-described conventional mechanisms involving hinges, levers, handles, or sub-chassis. Further, it would be advantageous if in at least some embodiments the improved apparatus and method achieved assembly of the support structures in a manner that did not result in significant frictional stress being placed on the connectors used to establish electrical connections among the support structures.

BRIEF SUMMARY OF THE INVENTION

The present invention in at least some embodiments relates to a connector assembly. The connector assembly includes a first structure having a first guiding surface, a second structure having a second guiding surface, a third structure having at least one additional guiding surface that interfaces each of the first and second guiding surfaces, and an electrically conductive component supported by at least one of the structures. Relative movement of the first structure in relation to the second structure in a first direction causes additional movement of the third structure in a second direction due to interaction among the guiding surfaces. Further, at least a portion of the electrically conductive component moves, in response to the additional movement to or away from a first position at which the component is capable of establishing an electrical connection.

Additionally, the present invention in at least some embodiments relates to an assembly. The assembly includes a first panel-type support structure having at least one electrical component, a second panel-type support structure, and a connector assembly capable of receiving the first panel-type support structure and coupled to the second panel-type support structure, the connector assembly including an electrically conductive member. Movement by the first panel-type support structure in a first direction causes a first portion of the connector assembly to move in a second direction, so that the electrically conductive member contacts the first panel-type support structure.

Further, the present invention relates to a method of assembling a first structure in combination with a second structure so as to establish an electrical connection between the structures. The method includes inserting the first structure into a first portion of a connector assembly that is coupled to a surface of the second structure. The method additionally includes causing the first portion of the connector assembly to move in a first direction substantially parallel to a surface of the second structure, where the causing of the first portion to move results in additional movement of a second portion of the connector assembly in a second direction differing from that of the first direction. The method further includes allowing an electrically conductive member of the connector assembly that is electrically coupled to the second structure to contact the first structure as a result of the additional movement of the second portion, whereby an electrical connection is established between the first and second structures by way of the electrically conductive member.

DETAILED DESCRIPTION OF THE PREFERRED EMBODIMENT

Figure 1:
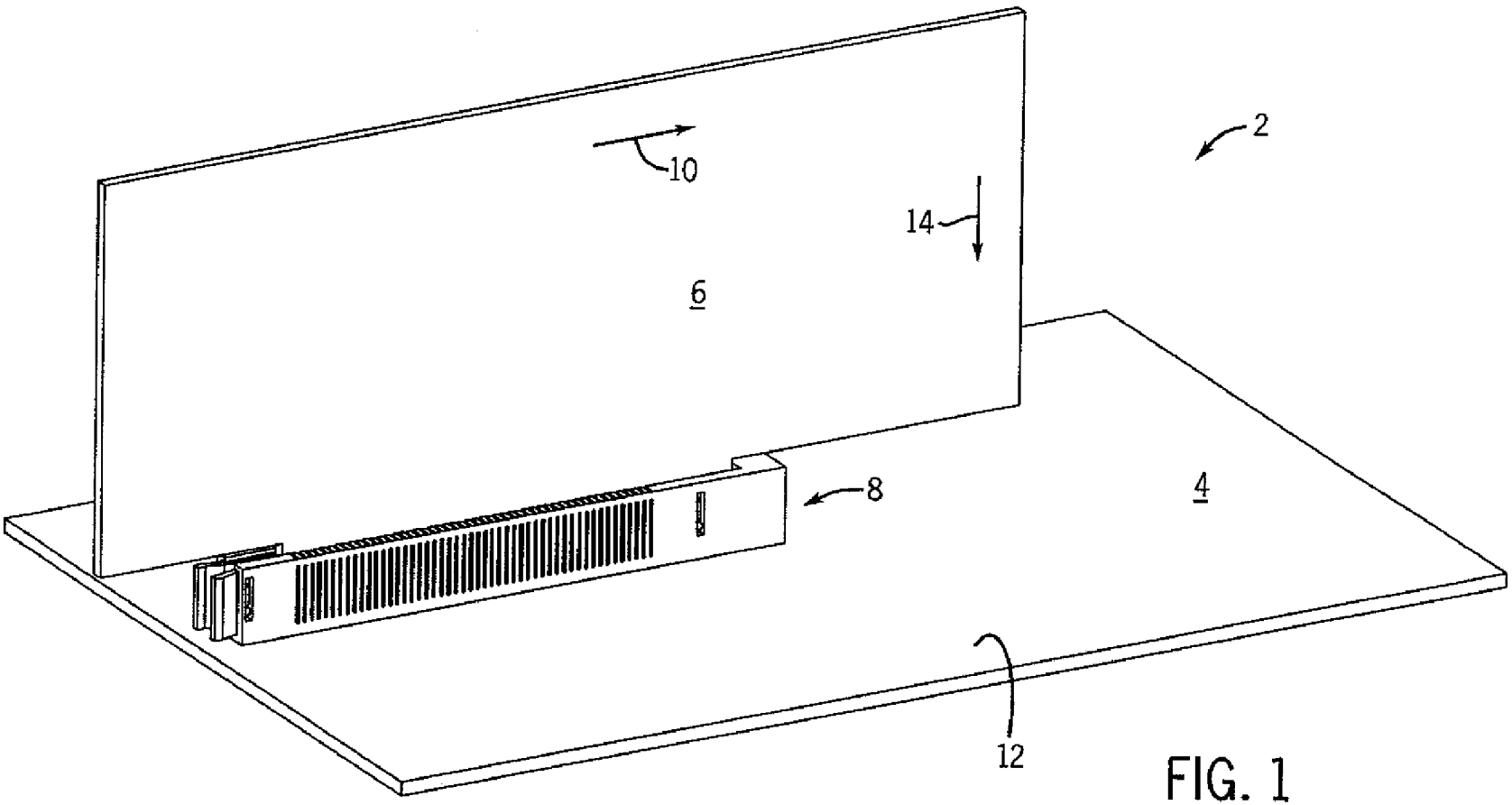
FIG. 1 is a top perspective view of an exemplary assembly having a motherboard and a daughtercard that are coupled together by way of an exemplary connector assembly in accordance with at least some embodiments of the present invention.

Referring to FIG. 1, an exemplary assembly 2 that can be implemented in a computer or other computerized device (not shown) includes a motherboard 4 and a daughtercard 6 connected together by way of a connector assembly 8. As will be described in further detail below, the connector assembly 8 facilitates the connecting or installation of the daughtercard 6 with respect to the motherboard 4 in an improved manner that involves merely the sliding of the daughtercard in the direction indicated by an arrow 10 that is generally parallel to a surface 12 of the motherboard 4, without requiring significant sliding movement along a direction indicated by an arrow 14 that is normal to the surface 12. Inversely, removal of the daughtercard 6 with respect to the motherboard 4 occurs by moving the daughtercard in a direction opposite to that indicated by the arrow 10, and does not require significant movement along a direction opposite to that indicated by the arrow 14. When the daughtercard 6 is installed with respect to the motherboard 4 by way of the connector assembly 8, one or more electrical connections between the daughtercard and motherboard are achieved.

Although the assembly 2 in the present embodiment includes the motherboard 4 and the daughtercard 6, the present invention is intended to encompass and pertain to a variety of different types of assemblies of components that can employed within computers and other computerized devices other than the particular structures shown in FIG. 1. Indeed, the present invention is intended to encompass a variety of assemblies of various boards (e.g., printed circuit boards), cards (e.g., peripheral component interconnect or "PCI" cards), and other structures on which are mounted various electrical components such as, for example, microprocessors, programmable logic devices (PLDs), memory devices, input/output devices and various other discrete components. Although the motherboard 4 and the daughtercard 6 in the present embodiment are shown to be orientated perpendicularly with respect to one another, the present invention is also intended to encompass embodiments in which boards, cards, or similar structures are assembled with one another to establish one or more electrical connections between those structures, where the structures are only substantially perpendicular, or not even close to being perpendicular, with respect to one another.

Figure 2:
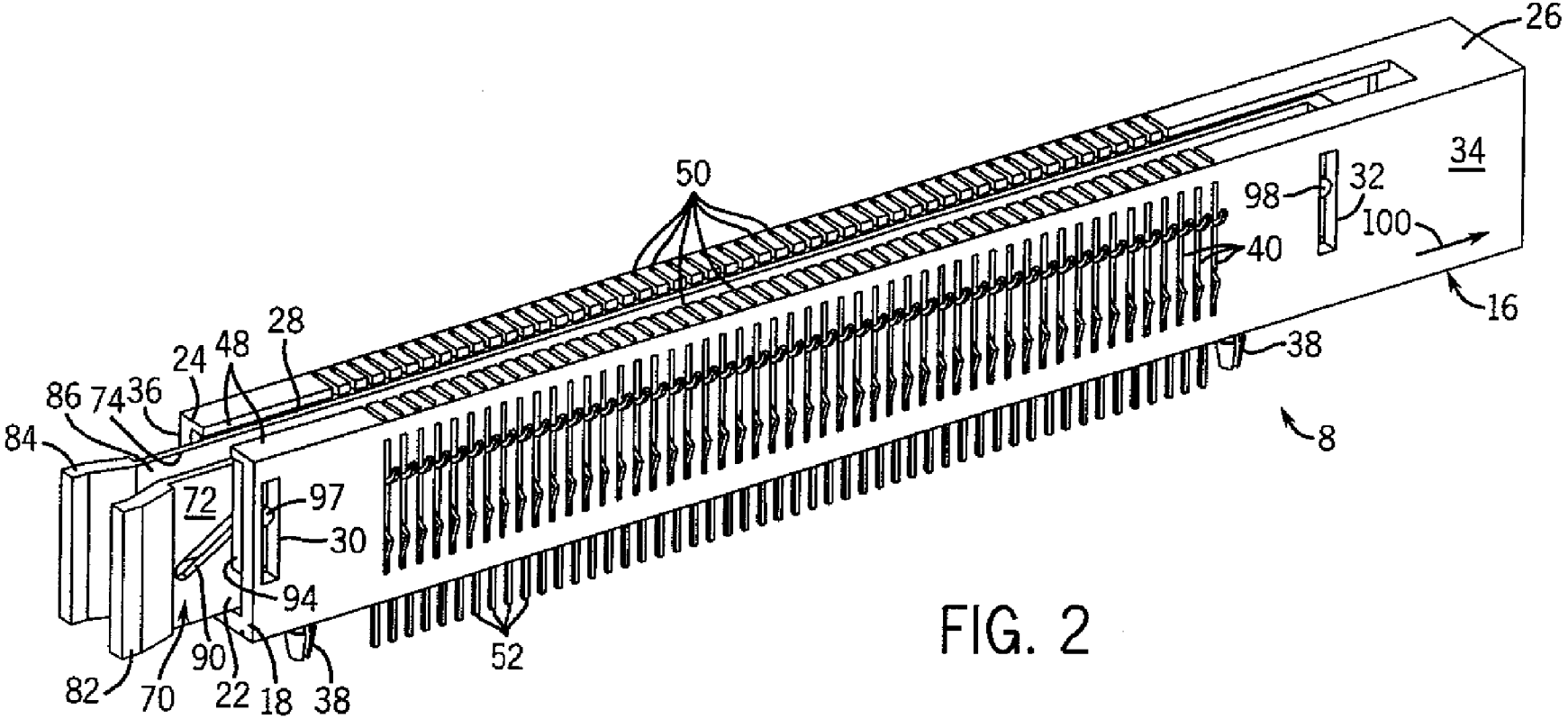
FIG. 2 is a top perspective view of the connector assembly of FIG. 1, shown in a first, uncoupled state.

Referring to FIG. 2, the connector assembly 8 of FIG. 1 is shown without the motherboard 4 or daughtercard 6 being present. As discussed in further detail below with respect also to FIGS. 3-6, the connector assembly 8 in the present embodiment includes five types of components. To begin with, referring additionally to FIG. 3, the connector assembly 8 includes an elongated base 16. As shown, the base 16 has first and second sidewalls 34 and 36, respectively, which are connected together by a floor 39 that is intended to abut the surface 12 of the motherboard 4 when the base is assembled thereto. When the floor 39 abuts the surface 12 of the motherboard 4, the sidewalls 34, 36 generally extend away from the surface 12 in a normal or perpendicular manner. The floor 39 also includes two protrusions 38 that have snapping features thereon, which can be inserted into corresponding holes (not shown) within the motherboard 4 and serve to anchor the base 16 onto the motherboard 4. With the sidewalls 34, 36 and floor 39, the base 16 has a substantially U-shaped cross section 18 and defines an interior channel 20 that extends almost the entire length of the base 16 along a longitudinal axis 46.

Further as shown, the base 16 has an opening 22 at a first end 24 such that access to the channel 20 at that first end is possible. However, a second end 26 of the base 16 is not open and the channel 22 ends at a location prior to that second end 26. Additionally, given its U-shaped cross section 18, the base 16 includes an elongated slot 28 extending substantially the same distance as the channel 22, that is, from the first end 24 to a location somewhat prior to the second end 26. Although the base 16 has the substantially U-shaped cross section 18 that is formed by a combination of the sidewalls 34 and 36 and the floor 39, it will further be noted that, at the edges of the sidewalls that are farthest from the floor 39, each of the sidewalls has an inwardly extending lip 48 that partially extends over the channel 20, such that the slot 28 has a narrower width than the channel.

In addition to the slot 28, the base 16 has several other slots as well. More particularly, the base 16 has two pairs of first and second guiding slots 30 and 32 that are respectively located on each of the first and second sidewalls 34 and 36, respectively, of the base 16 (only one of the guiding slots 32, namely, that of the first sidewall 34, is visible in FIG. 3). Each of the slots 30 and 32 extends approximately ⅔ of the height of its respective one of the sidewalls 34, 36. The first guiding slots 30 are positioned proximate the first end 24 of the base 16, while the second guiding slots 32 are positioned proximate the second end 26, albeit the slots 32 are not as close to the second end 26 as the slots 30 are to the first end 24.

Figure 3:
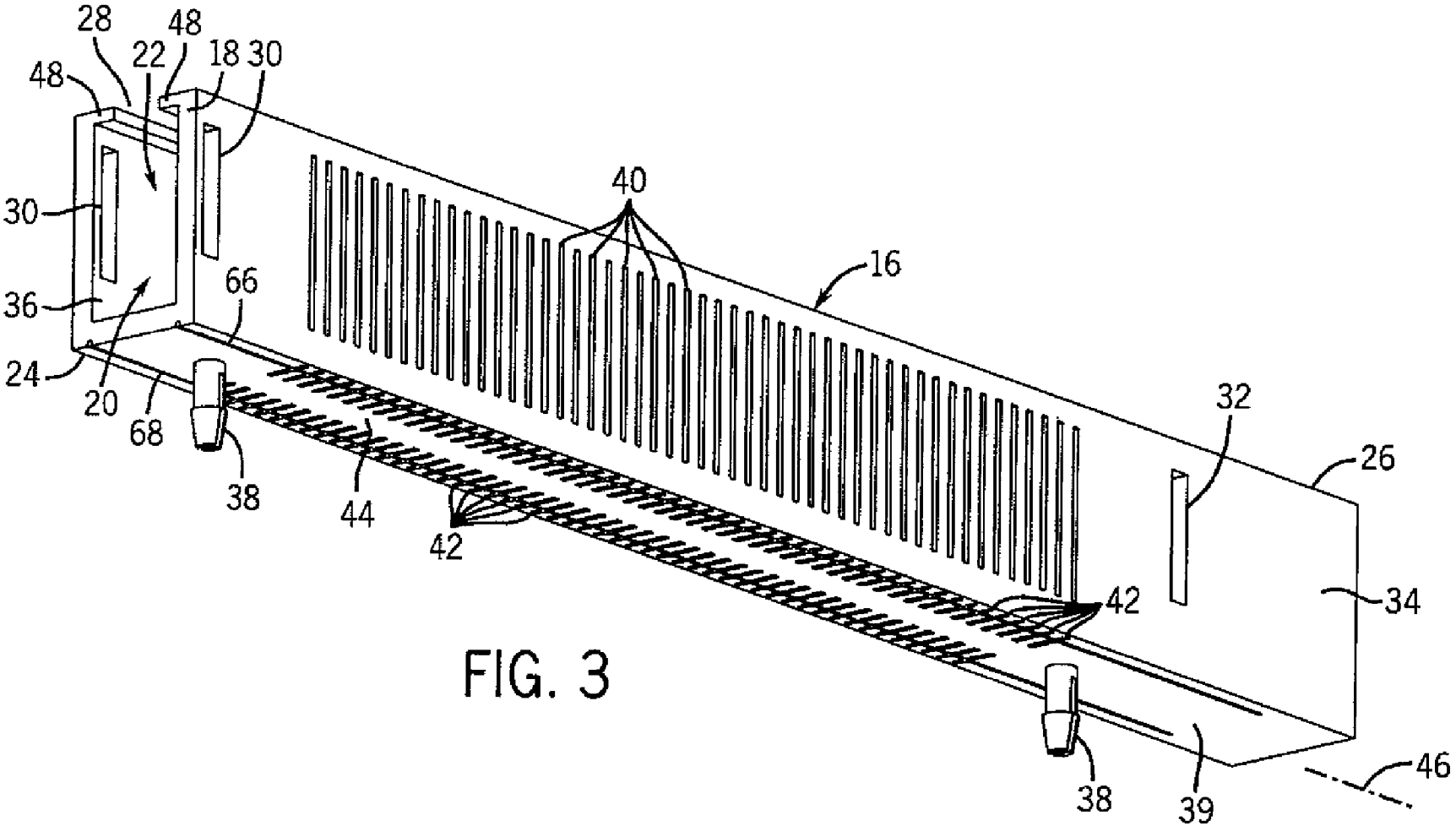
FIG. 3 is a bottom perspective view of a base that is part of the connector assembly of FIGS. 1 and 2.

In addition to the guiding slots 30, 32, the base 16 further has first and second arrays of substantially parallel pin slots 40 positioned between the first and second guiding slots 30 and 32, respectively, of each of the sidewalls 34 and 36, respectively. As will be described in further detail below, the pin slots 40 are configured to allow contact pins to protrude therethrough. The pin slots 40 in the present embodiment all are substantially parallel to the guiding slots 30 and 32 such that the pin slots are orientated generally perpendicularly to the longitudinal axis 46 and to the surface 12 of the motherboard 4 when the base 16 is assembled thereto. Further as shown in FIG. 3, in addition to the pin slots 40 in the sidewalls 34 and 36, the base 16 further has additional pin slots 42 arranged along the floor 39 of the base 16. In the present embodiment, the pin slots 42 extend along the floor 39 inward from the first and second sidewalls 34 and 36 toward a middle region 44 of the floor, again in a manner perpendicular to the longitudinal axis 46 (albeit parallel to the surface 12 of the motherboard 4 when the base is assembled thereto).

In the embodiment shown, there is one of the pin slots 42 for every one of the pin slots 40 on each of the sidewalls 34, 36 of the base 16. Thus, for example, while in the present embodiment there are fifty of the pin slots 40 on each of the sidewalls 34 and 36, there are also fifty of the pin slots 42 extending on either side of the middle region 44 of the floor 39. It will further be noted from the FIGS. (e.g., in FIG. 2) that the base 16 also has additional slots 50 along the lips 48 that are generally parallel with respect to the slots 42 along the floor 39. Although in the present embodiment these slots 50 are merely ornamental and need not even be present, in alternate embodiments it is possible that these slots also would operate so as to guide pins as do the slots 40, 42, as will be described in further detail below. Finally, in addition to the pin slots 42 extending along the floor 39, the floor also includes first and second location notches 66 and 68, respectively, which are located on opposite sides of the floor generally where the floor meets the first and second sidewalls 34 and 36, respectively. The notches 66 and 68 extend most of the length of the base in a manner parallel to the longitudinal axis 46 and, while doing so, cross/bisect the pin slots 42 on either side of the middle region 44.

Figure 4:
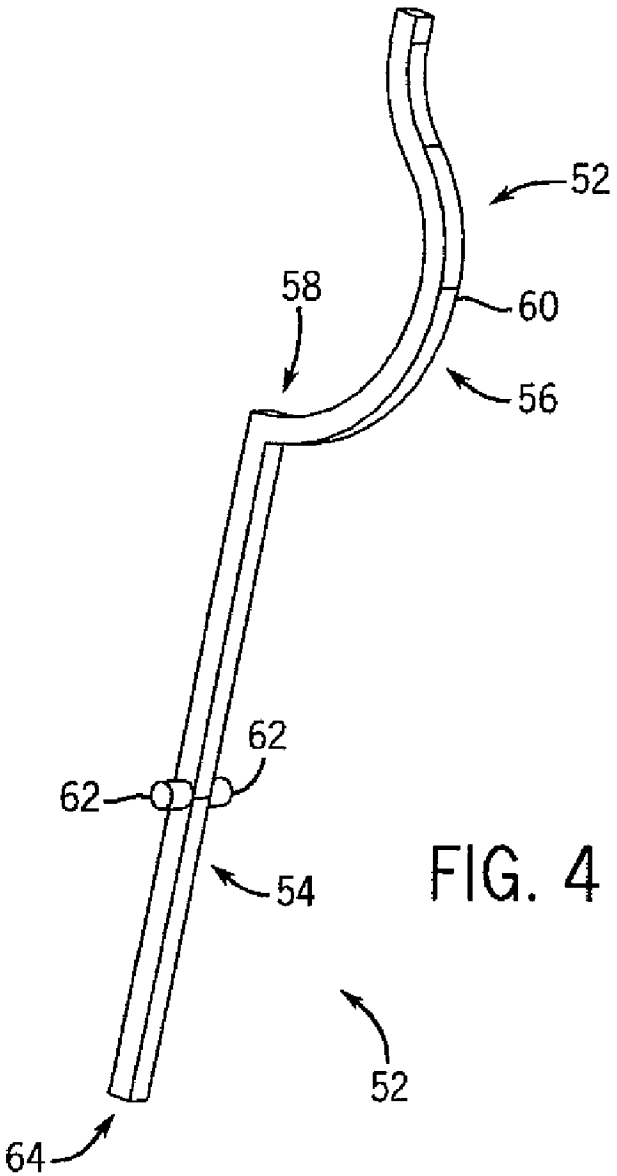
FIG. 4 is a side perspective view of one of several pins employed in the connector assembly of FIGS. 1 and 2.

As shown in FIG. 2, the connector assembly 8 additionally includes numerous (in this example, one hundred) pins 52, each of which extends through both a respective one of the pin slots 42 on one side or the other of the middle region 44 and also a corresponding one of the pin slots 40 positioned on the corresponding one of the sidewalls 34, 36. In at least some embodiments, the pins 52 are constructed from a springy material such as beryllium-copper alloy. FIG. 4 provides a perspective view of an exemplary one of the pins 52. As shown, the pin 52 has a straight section 54 and an S-shaped or question-mark-shaped section 56 that is attached at a first end 58 of the straight section 54. The S-shaped section 56 in particular first extends away from the end 58 in a direction that is substantially normal to the axis of the straight section 54, and then curves outward away from the straight section 54 so as to form a bump 60 that is intended to contact a complementary pad or other contact formed on a connector portion of the daughtercard 6 when the daughtercard is inserted into the connector assembly 8 as shown in FIG. 1.

Further, approximately midway along the straight section 54 between the first end 58 and a second end 64 of the straight section of the pin 52 are two prongs 62 that extend outward away from the straight section 54 in directions opposite to one another that are also perpendicular to the axis of the straight section 54. The prongs 62 of each pin 52 facilitate the proper positioning of the pin within its respective pin slots 42 and 40. More particularly, when one of the pins 52 is inserted into a corresponding pair of the slots 42 and 40 (e.g., one of the slots 40 on one of the sidewalls 34, 36 and the one of the slots 42 corresponding to that slot on the sidewall), the prongs 62 fit into portions of one of the first and second notches 66 and 68 on opposite sides of the particular slot 42 through which the pin protrudes.

Figure 5:
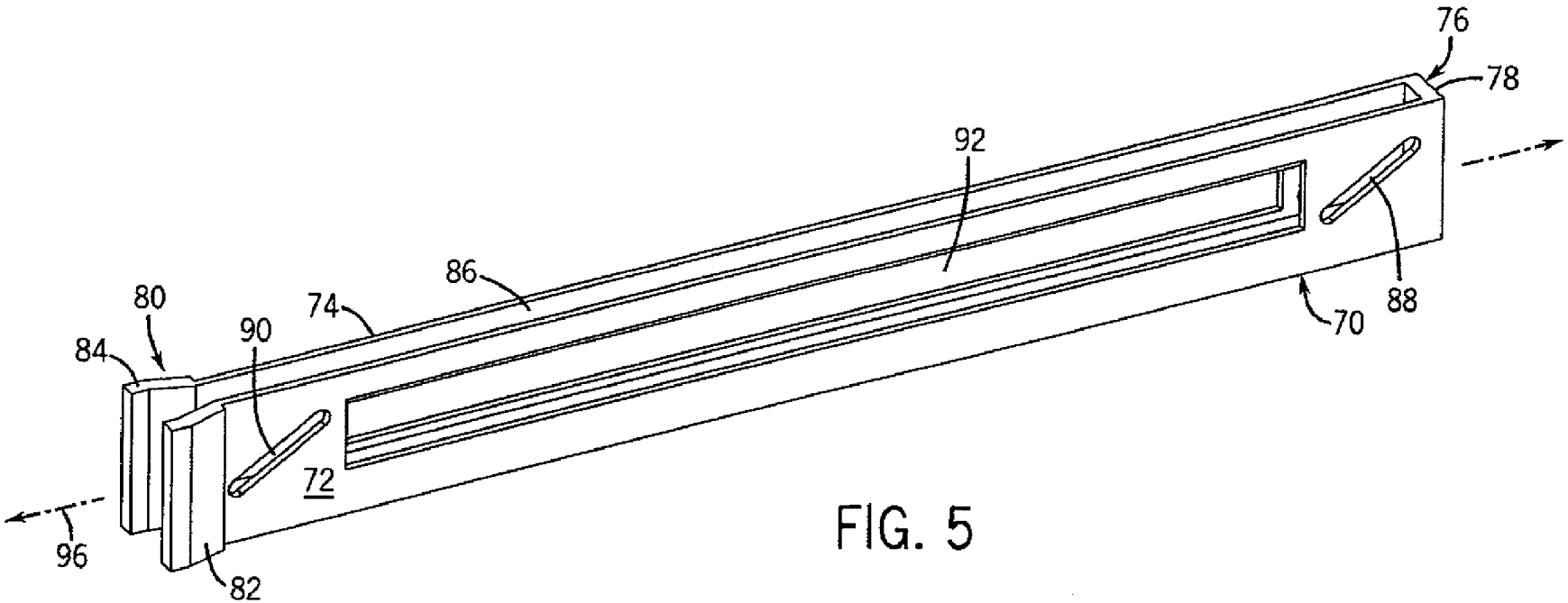
FIG. 5 is a top perspective view of a card guide that is part of the connector assembly of FIGS. 1 and 2.

Referring next to FIG. 5, the connector assembly 8 additionally includes a card guide 70. The card guide 70 is an additional elongated member that includes first and second elongated sidewalls 72 and 74, respectively, that at a first end 76 of the card guide are coupled by way of a back wall 78 and that at a second end 80 of the card guide are not coupled to one another, such that the overall card guide has a clip-type appearance. At the second end 80, the card guide 70 has first and second flanges 82 and 84 extending from each of the sidewalls 72 and 74, respectively. While the sidewalls 72 and 74 are generally parallel to a central axis 96 of the card guide 70, the first and second protrusions 82 and 84 extends somewhat obliquely relative to the central axis such that, as one proceeds outward away from the sidewalls 72, 74, the protrusions become increasingly separated from one another. Given their shape, the protrusions 82 and 84 effectively form a lead-in or guiding structure that serves to funnel an incoming structure such as the daughtercard 6 of FIG. 1 entering at the second end 80 into an intermediate channel 86 formed between the sidewalls 72, 74.

Also as shown in FIG. 5, each of the first and second sidewalls 72 and 74 has first, second and third orifices 88, 90 and 92, respectively, formed through it. The first and second orifices 88, 90 are substantially linear orifices that follow oblique or inclined paths relative to the central axis 96 of the card guide 70. The first orifices 88 are located on the sidewalls 72, 74 proximate the first end 76 of the card guide 70, while the second orifices 90 are located on the sidewalls proximate the second end 80 of the card guide (albeit not within the flanges 82, 84). As for the third orifices 92, each of those orifices also is a substantially linear slot. However, the orifices 92 are considerably wider than the orifices 88, 90, are positioned in between the orifices 88 and 90, and follow paths that are parallel to the central axis 96 of the card guide 70. As will be described in further detail below, the orifices 92 allow for the bumps 60 of the pins 52 to extend from positions outside of the card guide 70 to positions within the card guide (e.g., within the channel 86 of the card guide), while the orifices 88, 90 serve as guide slots for pins on a further structure discussed with respect to FIG. 6.

Figure 6:
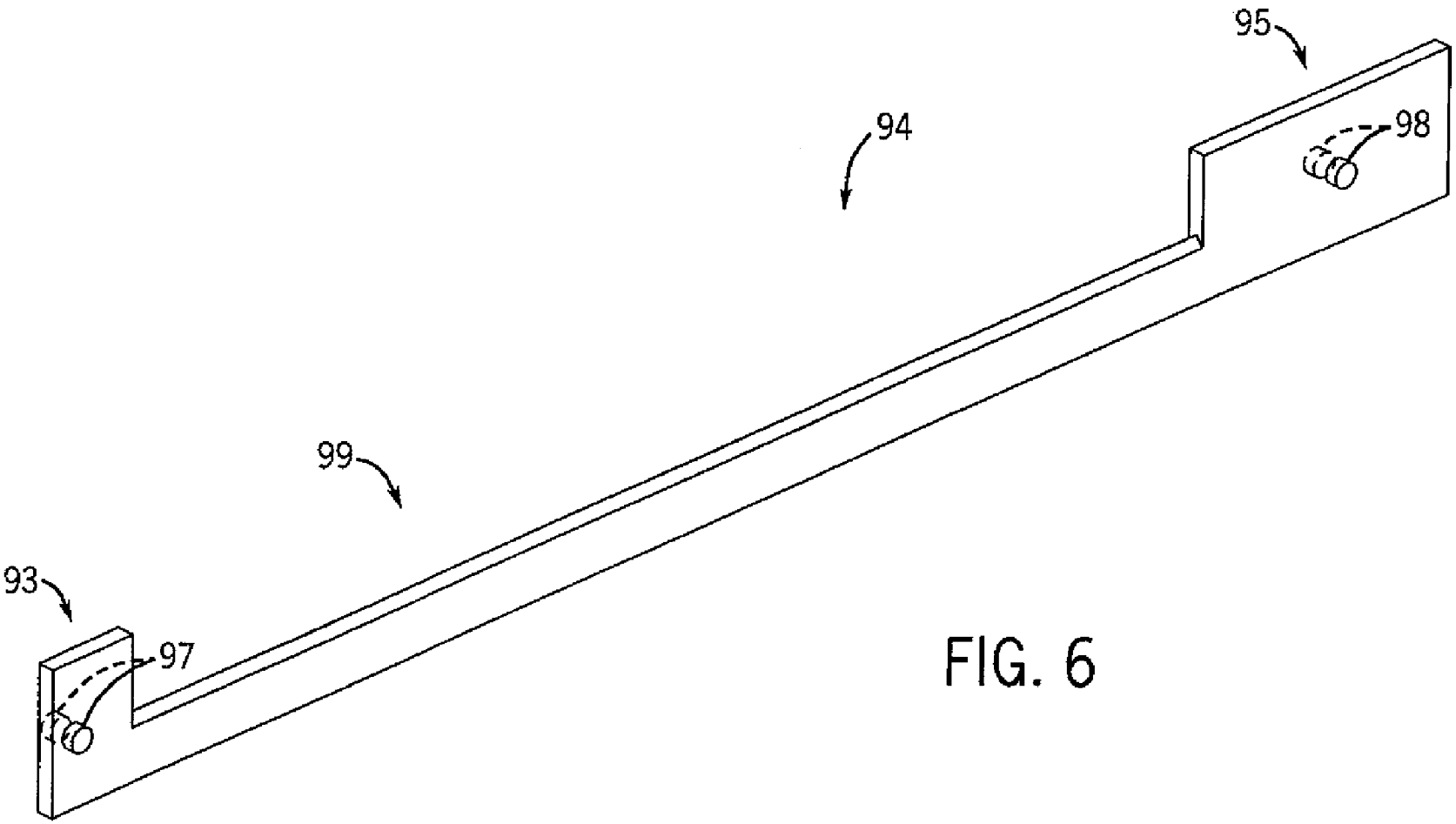
FIG. 6 is a top perspective view of an additional structure that is part of the connector assembly of FIGS. 1 and 2.

Turning then to FIG. 6, the connector assembly 8 further includes a pair of additional structures 94, one of which is shown. The additional structure 94 is a bar having first and second ends 93 and 95, respectively, at which are located first and second protruding pins 97 and 98, respectively. As shown, the pins 97, 98 protrude from both sides of the bar (FIG. 6 in particular shows the pins 97, 98 protruding on one side of the bar and shows in phantom those pins also protruding from the other side of the bar). The additional structure 94 further includes a cutout 99 extending most of the distance between the two ends at which the respective pins 97, 98 are positioned, such that the overall bar has a width along most of its length that is half or less than half of its width at its ends.

Returning to FIG. 2, the base 16, the card guide 70, the additional structures 94, and the multiple pins 52 forming the connector assembly 8 are shown together in assembled form. In particular, the card guide 70 is positioned within the channel 20 of the base 16 and extends most of the length of that channel through the base. Additionally, the card guide 70 is orientated relative to the base 16 such that the intermediate channel 86 of the card guide is substantially aligned with the elongated slot 28 of the base. Further, the two additional structures 94 are positioned respectively between the first sidewall 72 of the card guide 70 and the first sidewall 34 of the base 16 and between the second sidewall 74 of the card guide and the second sidewall 36 of the base, respectively. The pins 97 of the additional structures 94 protrude into the first guiding slots 30 of the sidewalls 34, 36 and into the second orifices 90 of the sidewalls 72, 74, while the pins 98 of the additional structures protrude into the second guiding slots 32 of the sidewalls 34, 36 and into the first orifices 88 of the sidewalls 72, 74.

Because the pins 97, 98 of the additional structures 94 protrude both into the guiding slots 30, 32 of the sidewalls 34, 36 of the base 16 and also into the orifices 88, 90 of the sidewalls 72, 74 of the card guide 70, movement of the card guide 70 relative to the base 16 results in movement of the additional structures 94. More particularly, the oblique arrangement of the orifices 88, 90 of the card guide 70 in relation to the comparatively vertical arrangement of the guiding slots 30, 32 of the base 16 is such that relative movement of the card guide 70 inward into the base 16 along a path indicated by an arrow 100 in FIG. 2 (which is parallel to the axes 46 and 96 of the base 16 and card guide 70 shown in FIGS. 3 and 5) causes the two additional structures 94 to be forced away from the floor 39 of the base 16 and toward the slots 50 along the opposite surface of the base due to the interaction of the pins 97, 98 with the orifices 88, 90 and guiding slots 30, 32. Alternatively, if the card guide 70 is pulled outward from the base 16 in a direction opposite to that shown by the arrow 100, then the two additional structures 94 are forced away from the pin slots 50 and toward the floor 39. The inner surfaces of the orifices 88, 90 thus effectively serve as ramps for the pins 97, 98 of the additional structures 94, while the inner surfaces of the guiding slots 30, 32 serve to keep the additional structures from moving within the base 16 along or in opposition to the direction indicated by the arrow 100.

Further, depending upon the positioning of the additional structures 94 relative to the base 16, as determined by the positioning of the card guide 70 relative to the base, the pins 52 are varied in their positioning. As shown in FIG. 2, and further shown in FIG. 7, which is a cutaway perspective view of the connector assembly 8 of FIG. 2 with the base 16 absent, when the card guide 70 is moved outward away from the base contrary to the direction indicated by the arrow 100 such that the additional structures 94 move away from the floor 39 of the base, the pins 52 are forced outward away from the card guide 70 (and its intermediate channel 86) because the bumps 60 of the pins encounter the additional structures 94, which are then positioned in between the pins and the card guide. In this circumstance, the pins 52 are bent or contorted and are blocked from coming into contact with any structures that are within the intermediate channel 86 of the card guide, and more particularly are unable to come into contact with any pads or other structures of the daughtercard 4 that might be present within the intermediate channel. Consequently, FIGS. 2 and 7 are representative of the connector assembly 8 when it is in an uncoupled state, and it can be seen that the additional structures 94 in this circumstance serve as barrier structures with respect to the pins 52.

Figure 7:
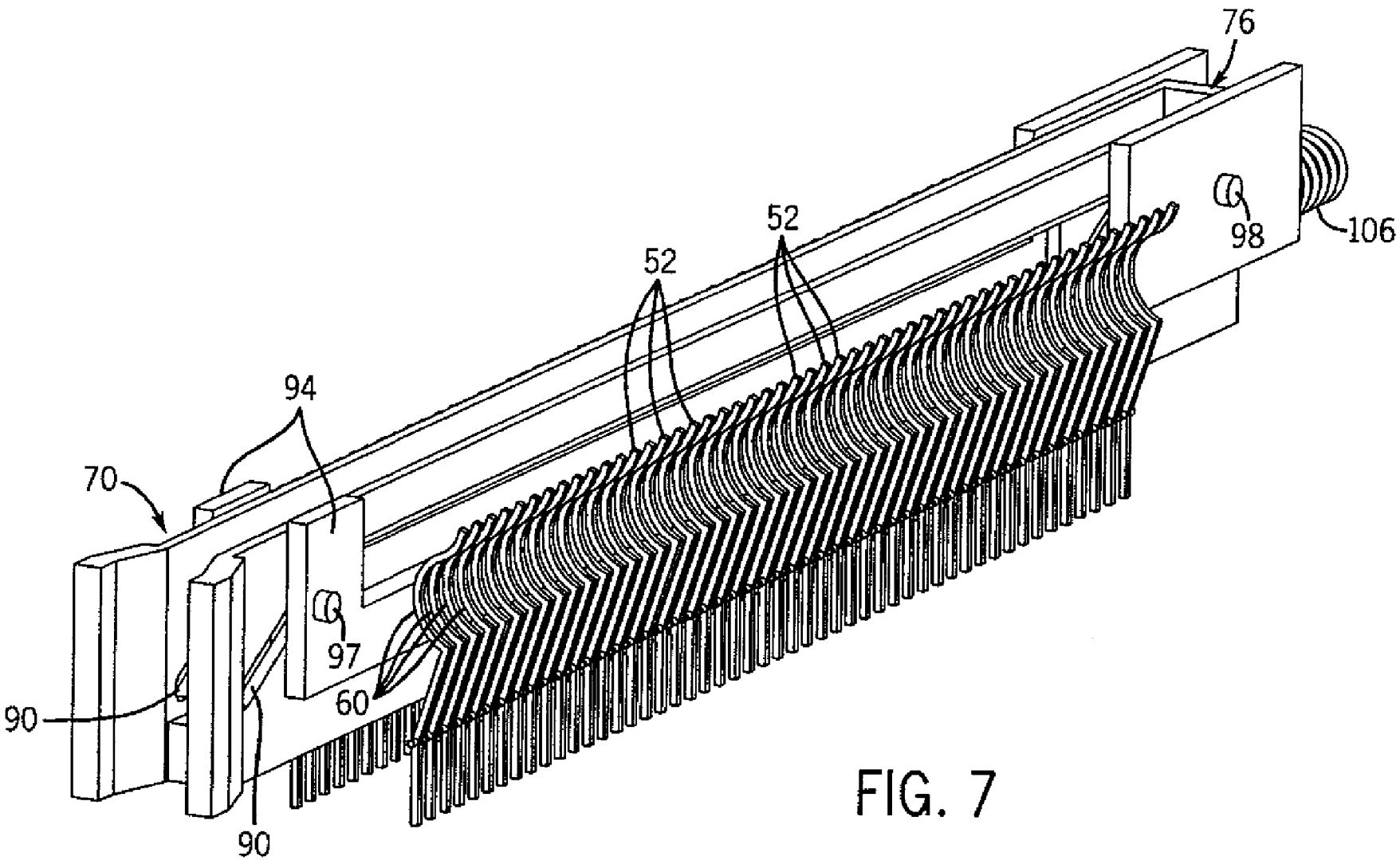
FIG. 7 is a top perspective view of portions of the connector assembly of FIGS. 1 and 2 in the first, uncoupled state, where the base of the connector assembly is not shown.
Figure 8:
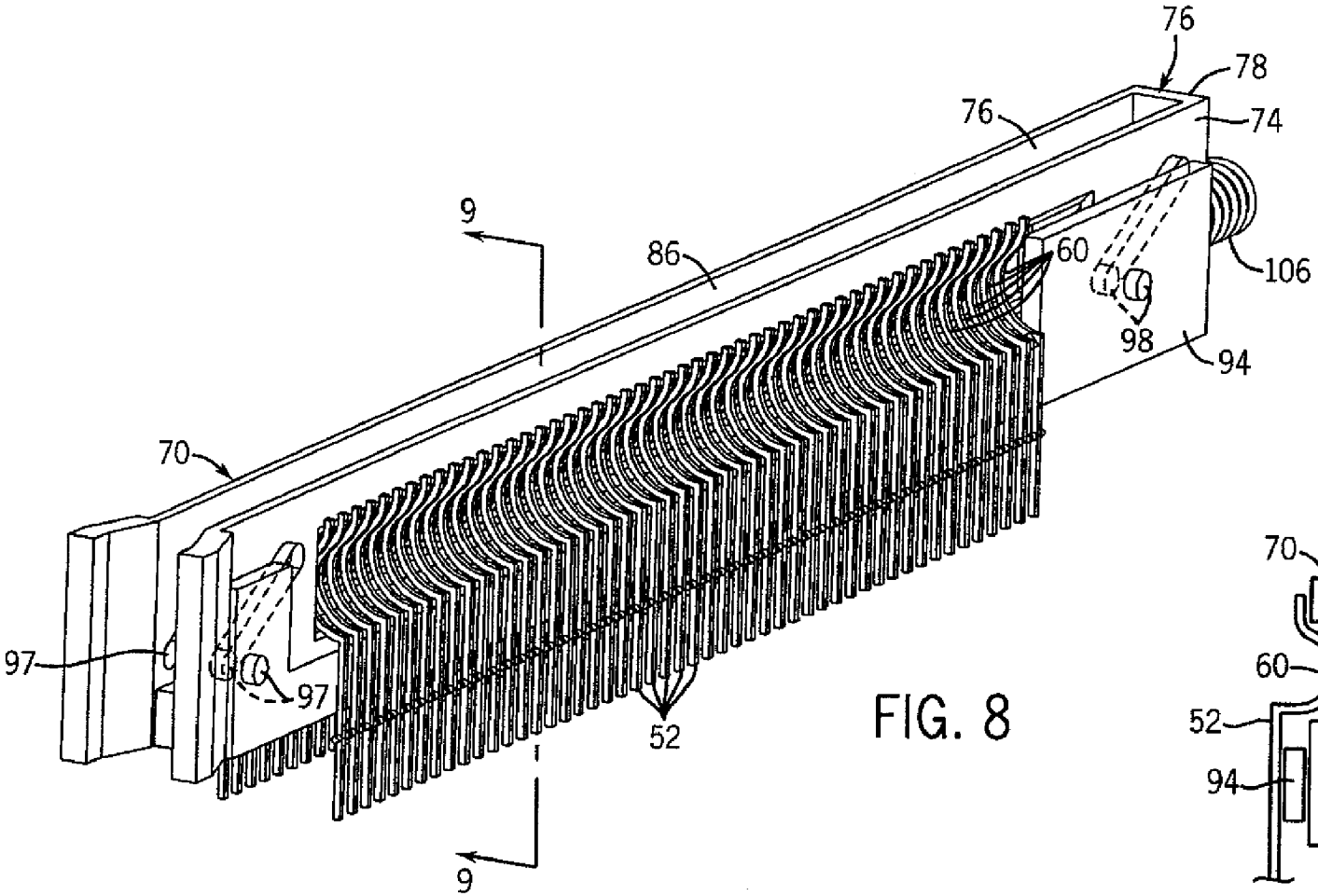
FIG. 8 is a top perspective view of portions of the connector assembly of FIGS. 1 and 2 in a second, coupled state, where the base of the connector assembly is not shown.

Turning to FIG. 8, the components of the connector assembly 8 that are shown in FIG. 7 (e.g., the card guide 70, the additional structures 94, and the pins 52, but not the base 16) are shown again, in this case, in positions that those components take when the connector assembly is in a second, coupled state. As shown, when the card guide 70 is moved inward relative to the base 16 along the direction indicated by the arrow 100 of FIG. 2, the additional structures 94 are forced downward toward the floor 39 of the base 16 due to the interaction of the pins 97, 98 of the additional structures with the guiding slots 30, 32 and additionally with the first and second orifices 88, 90 of the card guide. When the additional structures 94 are moved in this manner, the cutouts 99 of the additional structures become aligned with the third orifices 92 of the card guide 70. Consequently, the pins 52 are able to return to their unbent, normal positions such that the bumps 60 of the pins protrude inward toward and into the intermediate channel 86 within the card guide 70, past the additional structures 94 and through the sidewalls 72, 74 of the card guide.

Figure 9:
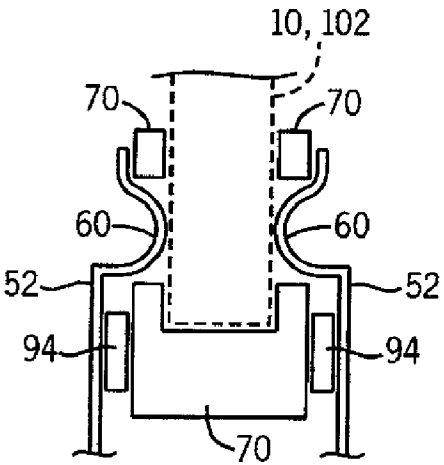
FIG. 9 is a cross-sectional view of the portions of the connector assembly of FIG. 8 in the second, coupled state, taken along a line 9-9 of FIG. 8, in combination with a portion of a daughtercard shown in phantom.

Referring additionally to FIG. 9, a cross-sectional view of the components shown in FIG. 8 (taken along line 9-9 of FIG. 8) is shown in combination with a connecting portion 102 of the daughtercard 6 of FIG. 1 (shown in phantom). As illustrated, when the components of the connector assembly 8 take on the positions shown in FIG. 8, and the connecting portion 102 of the daughtercard 6 is positioned within the intermediate channel 86 of the card guide 70 (as well as within the slot 28 of the base 16), the bumps 60 of the pins 52 are able to come into contact with that connecting portion and, more particularly, are able to come into contact with appropriate electrical connectors such as pads that are positioned on that connecting portion. Thus, FIGS. 8 and 9 show the components of the connector assembly 8 (except with the base 16 not shown) in a second, coupled state that allows for the pins 52 to be electrically coupled to complementary features on the daughtercard 6. Since the pins 52 (e.g., the straight sections 54 of the pins) are coupled to the motherboard 4, the connector assembly 8 when in the coupled state further allows the daughtercard 6 to be electrically coupled to the motherboard 4.

The connector assembly 8 as described above with respect to FIGS. 1-9 allows for easy installation and removal of the daughtercard 6 with respect to the motherboard 4 and, more particularly, allows for installation and removal that does not involve substantial amounts of frictional contact between the pads/contacts of the daughtercard and the pins 52 of the connector assembly. When the daughtercard 6 (particularly the connecting portion 102) is first inserted into the connector assembly 8 by way of the flanges 82 and 84, the connector assembly is as shown in FIG. 2 and consequently the pins 52 are kept away from any corresponding contacts on the daughtercard at this time. However, as the daughtercard 6 is further inserted into the connector assembly 8, a leading edge of the daughtercard eventually reaches the back wall 78 of the card guide 70. Further movement of the daughtercard 6 results in (or at least corresponds to) movement of the card guide in the direction indicated by the arrow 100 of FIG. 2. As this occurs, the additional structures 94 are gradually lowered toward the floor 39 of the base and the pins 52 are allowed to come into contact with the daughtercard 6. Due to this gradual movement, large amounts of friction between the pins 52 and the daughtercard 6 do not occur at all or at least only occur over a very limited range of relative motion between the daughtercard and the pins. Eventually, the arrangement shown in FIG. 9 (and FIG. 1) is attained.

As shown in FIGS. 7 and 8, in the present embodiment, the connector assembly 8 further includes a spring 106 that is positioned between the back wall 78 of the card guide 70 and the second end 26 of the base 16 (see FIG. 2). The spring 106 tends to counteract the movement of the card guide 70 into the base 16 along the direction indicated by the arrow 100 of FIG. 2 (and may also help to prevent excessive pulling out of the card guide relative to the base). Consequently, when a daughtercard is not present and the intermediate channel 86 is empty, the connector assembly 8 tends to the uncoupled state shown in FIG. 2 with the card guide 70 extending outward from the base 16 as far as is possible given the restraint imposed by the interaction of the pins 97, 98 and the orifices 88, 90. However, once the daughtercard 6 is fully inserted, the positioning of the card guide 70 and daughtercard 6 relative to the base 16 and the motherboard 4 is maintained, notwithstanding the spring 106, due to various factors. These can include, for example, the existence of friction among the card guide 70, base 16, and additional structures 94 as well as between the daughtercard 6 and the pins 52. In at least some alternate embodiments, a locking mechanism or feature is provided that allows for the daughtercard 6 and/or card guide 70 to be locked in place relative to the motherboard 4 and/or base 16.

When removal of the daughtercard 6 is desired, the removal proceeds in a manner that is the opposite of that described above, with large amounts of friction either not occurring at all or occurring only over a very limited range of relative movement when the removal process is first commenced. Removal can be facilitated due to the action of the spring 106. Also, the flanges 82, 84 can provide an operator with a useful grabbing feature by which the operator can apply pressure to the connector assembly 8 so as to remove the daughtercard 6 (the flanges 82, 84 also in some circumstances could be similarly grasped by an operator while installing the daughtercard).

The embodiment described above with respect to FIGS. 1-9 is advantageous in part because movement of the daughtercard 6 and the card guide 70 along the direction indicated by the arrow 10 of FIG. 1 (which is also the direction indicated by the arrow 100 of FIG. 2), which is movement that is parallel to the surface 12 of the motherboard 4, not only results in the daughtercard being positioned over the motherboard but also automatically results in the daughtercard being electrically coupled to the pins 52 and thus to the motherboard. That is, the linear movement of the daughtercard 6 parallel to the surface 12 of the motherboard 4 results both in relative translation between those two structures and also in electrical coupling of those two structures that, in conventional mechanisms, might only be achieved by physical lowering of the daughtercard toward the motherboard (e.g., movement of the daughtercard toward the motherboard in a manner that is normal to the surface 12 of the motherboard). A connection achieved by way of conventional, perpendicular motion is also still allowed by this connector as well.

The embodiment described above is only one exemplary embodiment of a variety of structures and assemblies that are encompassed by the present invention. That is, the present invention is intended to encompass a wide variety of other embodiments that would include some or all of the above-described features, or variations of these features. For example, in some alternate embodiments, the pins 52 can take a different shape than that shown, so long as the pins include portions that are capable of making contact with corresponding connecting pads or other contacts and at the same time can be moved towards or away from those pads/contacts.

Also, in other embodiments, the various orifices 88 and 90 can take a slightly different form than the linear form shown, for example, the orifices can have curvilinear shapes. Indeed, the particular interfacing guiding surfaces provided in the present embodiment of the invention, e.g., by the guiding slots 30, 32, the orifices 88, 90, and the pins 97, 98, in alternate embodiments could take a variety of other forms. For example, in one alternate embodiment, slots/orifices could be provided on the additional structure 94 and interfacing pins or other protrusions could be positioned on the base 16 and the card guide 70.

Further, while the daughtercard 6 shown above is intended to be mounted substantially perpendicularly with respect to the motherboard 4 in FIG. 1, the present invention is intended to encompass any arrangements of board or cards or similar structures having connectors that can be respectively connected in a manner such as or similar to that discussed above. For example, it is possible for two boards to be connected to one another in a substantially parallel fashion if the pins in the connector assembly include base sections (e.g., sections corresponding to the straight sections 54) that include 90 degree bends, such that the floor of the connector assembly (e.g., corresponding to the floor 39 described above) no longer needs to be the surface of the connector assembly that is in contact with the motherboard.

Further, while the above description largely considers an assembly of one support structure (e.g., the daughtercard) onto another support structure (e.g., the motherboard), it should be understood that the present invention is intended to encompass embodiments in which multiple support structures are assembled onto another support structure (e.g., multiple daughtercards being mounted onto the same motherboard). Also, it should be noted that the above usage of terms that could potentially be construed as indicating a direction or orientation (e.g., "back", "side", "vertical", "floor", etc.) has only been done in order to facilitate description of the components in relation to one another, and is not intended to suggest that the above-described components need be orientated in relation to a physical support or ground in any particular manner. Rather, the present invention is intended to encompass embodiments employing boards, cards, connectors, and other structures in any and all different physical orientations.

It is specifically intended that the present invention not be limited to the embodiments and illustrations contained herein, but include modified forms of those embodiments including portions of the embodiments and combinations of elements of different embodiments as come within the following claims.

I claim:

1. A connector assembly comprising:

a first structure having a first guiding surface;

a second structure having a second guiding surface;

a third structure having at least one additional guiding surface that interfaces each of the first and second guiding surfaces; and an electrically conductive component supported in relation to the second structure, wherein relative movement of the first structure in relation to the second structure along a first direction causes additional movement of the third structure in relation to the second structure, the additional movement occurring in a second direction due to interaction among the guiding surfaces, the second direction including a first component that is substantially perpendicular to the first direction, and wherein at least a portion of the electrically conductive component moves, in response to the additional movement, to or away from a first position at which the electrically conductive component is capable of establishing an electrical connection, the moving of the portion of the electrically conductive component being in a third direction that is substantially perpendicular to both the first direction and the first component.

2. The connector assembly of claim 1, wherein the first structure extends within the second structure, and wherein the first structure at a first end has a guiding feature configured to facilitate a guiding of an additional structure into the first structure.

3. The connector assembly of claim 1, wherein the electrically conductive component is supported within at least one slot formed within the second structure, wherein the first and second guiding surfaces are inner surfaces of first and second orifices within first and second walls of the first and second structures, respectively, and wherein the at least one additional guiding surface includes first and second pin surfaces of first and second pins extending through the first and second orifices, respectively.

4. The connector assembly of claim 1, wherein the first structure is configured to receive an additional structure on which is located an electrically connective feature.

5. The connector assembly of claim 4, wherein the first structure includes first, second and third walls, the second wall being substantially parallel to the first wall and the third wall connecting the second wall to the first wall at a first end of the first structure, and wherein the first structure is configured to receive the additional structure at a second end of the first structure opposite the first end, the additional structure proceeding through an opening located at the second end and continuing between the first and second walls until the additional structure encounters the third wall.

6. The connector assembly of claim 1, wherein the second structure is configured to be mounted on an additional structure.

7. The connector assembly of claim 6, wherein the electrically conductive component is electrically coupled to another electrically conductive component on the additional structure, wherein the additional structure is a motherboard.

8. The connector assembly of claim 1, wherein the electrically conductive component is a pin having a straight section and a curved section.

9. The connector assembly of claim 8, wherein the additional movement of the third structure in the second direction causes the third structure to be withdrawn relative to the curved section of the pin, so that the curved section then is able to pass from a first side of the first structure to a second side of the first structure and as a result is configured for establishing the electrical connection.

10. The connector assembly of claim 8, further comprising an additional plurality of electrically conductive components that are additional pins.

11. An assembly comprising the connector assembly of claim 1, and further comprising a first panel-type structure that is at least one of a card and a board, wherein the panel-type structure is received along a first wall of the first structure, and wherein the electrically conductive component contacts at least one electrically conductive feature on the panel-type structure when the electrically conductive component moves to the first position.

12. The assembly of claim 11, wherein the first panel-type structure includes a connecting portion that slides within a slot within the first structure when the panel-type structure is received along the first wall, and wherein the panel-type structure along with the first structure move together along the first direction once the panel-type structure encounters a back wall of the first structure.

13. The assembly of claim 12, wherein the electrically conductive component is electrically coupled to a second panel-type structure.

14. The assembly of claim 13, wherein the first panel-type structure extends in a manner that is substantially perpendicular to a surface of the second panel-type structure, and wherein the first direction is substantially parallel to the surface.

15. The assembly of claim 13, wherein the second panel-type structure is a motherboard and the first panel-type structure is a daughtercard.

16. A computerized device including the assembly of claim 13.

17. An assembly comprising:

a first panel-type structure including at least one electrical component;

a second panel-type structure; and a connector assembly capable of receiving the first panel-type structure and coupled to the second panel-type structure, the connector assembly including first and second portions and an electrically conductive member supported in relation to the second portion, wherein movement by the first panel-type structure in a first direction causes the first portion of the connector assembly to move in a second direction in relation to the second portion of the connector assembly, the second direction including a first component substantially perpendicular to the first direction, so that the electrically conductive member experiences additional movement in a third direction that is substantially perpendicular to both the first direction and the first component, and so that the electrically conductive member contacts the at least one electrical component of the first panel-type structure.

18. The assembly of claim 17, wherein the connector assembly includes means for receiving the first panel-type structure and means for supporting each of the first portion and the means for receiving, and wherein the movement by the first panel-type structure causes relative movement of the means for receiving with respect to the means for supporting, which in turn causes the first portion to move in the second direction.

19. The assembly of claim 18, wherein each of the first and second panel-type structures is one of a printed circuit board and a card.

20. A method of assembling a first structure in combination with a second structure so as to establish an electrical connection between the structures, the method comprising:

inserting the first structure into a first portion of a connector assembly that is coupled to a surface of the second structure;

causing the first portion of the connector assembly to move in a first direction substantially parallel to a surface of the second structure, wherein the causing of the first portion to move results in additional movement of a third portion of the connector assembly in relation to a second portion, the additional movement occurring in a second direction including a first component that is substantially perpendicular to that of the first direction; and allowing an electrically conductive member of the connector assembly that is electrically coupled to the second structure and supported in relation to the second portion to experience movement in a third direction that is substantially perpendicular to both the first direction and the first component and to thereby contact the first structure as a result of the additional movement, whereby an electrical connection is established between the first and second structures by way of the electrically conductive member.

21. The method of claim 20, further comprising:

causing the first structure and the first portion to move in a fourth direction opposite to the first direction, which in turn causes the third portion of the connector assembly to move in a fifth direction opposite to the second direction so that the third portion moves into place as a barrier between the electrically conductive member and the first structure, whereby the electrical connection is broken.

22. A connector assembly comprising:

a base member having a channel portion and a plurality of slots;

a guide member having a plurality of orifices, the guide member being positioned within the channel portion of the base member;

at least one additional structure having a plurality of pins, the at least one additional structure being positioned within the channel portion between the guide member and the base member so that each pin is positioned within a respective one of the slots and orifices; and at least one electrically conductive component supported in relation to the base member;

wherein relative translational movement of the guide member in relation to the base member along a first direction causes additional movement of the at least one additional structure in a second direction due to interactions of surfaces of the pins with interfacing surfaces of the slots and orifices, the second direction having a first component that is substantially perpendicular to the first direction, and wherein, in response to the additional movement, at least a portion of the at least one electrically conductive component moves in a third direction that is substantially perpendicular to both the first direction and the first component, to or away from a first position at which the at least one electrically conductive component is capable of establishing at least one electrical connection.

* * * * *

UNITED STATES PATENT AND TRADEMARK OFFICE

CERTIFICATE OF CORRECTION

PATENT NO. : 7,374,441 B2
APPLICATION NO. : 11/532331
DATED : May 20, 2008
INVENTOR(S) : Brandon Rubenstein It is certified that error appears in the above-identified patent and that said Letters Patent is hereby corrected as shown below:

On the Title Page, Item (56), under "Other Publications", line 1, delete "P620" and insert -- P650 --, therefor.

Signed and Sealed this

Fifth Day of August, 2008

JON W. DUDAS
*Director of the United States Patent and Trademark Office*